United States Patent [19]

Finsterwalder

[11] 4,003,327

[45] Jan. 18, 1977

[54] MONOLITHIC SHIP'S BODY OF STEEL CONCRETE OR PRESTRESSED CONCRETE

[75] Inventor: Ulrich Finsterwalder, Munich, Germany

[73] Assignee: Firma Dyckerhoff & Widmann Aktiengesellschaft, Munich, Germany

[22] Filed: Aug. 21, 1975

[21] Appl. No.: 606,483

[30] Foreign Application Priority Data

Aug. 29, 1974 Germany ..... 2441376

[52] U.S. Cl. ..... 114/65 A; 114/56; 114/62; 114/74 R

[51] Int. Cl.[2] ..... B63B 35/44

[58] Field of Search ..... 114/65 A, 56, 62, 61, 114/.5 T, 78, 74 R, 65 R, 74 A, 26; 115/39

[56] References Cited

UNITED STATES PATENTS

| | | | |
|---|---|---|---|
| 23,105 | 3/1859 | Montgomery | 114/56 |
| 396,648 | 1/1889 | Cornwall | 114/62 |
| 1,776,319 | 9/1930 | Magdits | 114/56 |
| 3,833,035 | 9/1974 | Yee | 114/65 A |

FOREIGN PATENTS OR APPLICATIONS

| | | | |
|---|---|---|---|
| 24,860 | 8/1919 | Denmark | 114/65 A |
| 837,130 | 2/1939 | France | 114/61 |

*Primary Examiner*—Trygve M. Blix
*Assistant Examiner*—Charles E. Frankfort
*Attorney, Agent, or Firm*—Toren, McGeady and Stanger

[57] ABSTRACT

A monolithic ship's body is formed of a hull containing bulkhead partitions disposed in a hexagonal arrangement to form a grid symmetrical about the longitudinal axis of the hull. The partitions are formed integrally with the hull. The junction between the side walls and the bottom of the hull is curved. Further, the bottom of the hull also has a curved configuration transversely of the longitudinal axis providing alternating convex and concave surfaces so that the bottom acts a hollow arch. The deck is formed integrally with the hull and the bulkhead partitions and is curved transversely to the longitudinal axis with its upper surface being convex. Steel concrete or prestressed concrete can be used in forming the monolithic ship's body.

10 Claims, 3 Drawing Figures

MONOLITHIC SHIP'S BODY OF STEEL CONCRETE OR PRESTRESSED CONCRETE

The invention concerns a monolithic ship's body of steel concrete or prestressed concrete with an outer skin of bottom and side walls, as well as a deck surface and reinforcing bulkhead partitions.

In the production of monolithic ship's bodies of steel concrete, the constructions with frames and longitudinal girders customary in steel was copied in concrete. This construction, however, is not favorable for concrete. Besides the expenditures for the forms for the concrete parts are relatively high. It is also known to make the outer skin, seen in a cross section, curved like a dish to achieve an arch supporting effect and thus to reduce the thickness of the outer skin and to obtain smooth walls for which the expenditures for forms are lower. In order to subdivide the ship's body into individual section, which is necessary for safety reasons, longitudinal and transverse bulkheads are used which form a right-angled raster.

With increasing size of the ship's body, the thickness of the parts increases necessarily with increasing stresses; this increases the weight, which is anyway high in concrete ships, so that the draft is increased relative thereto or the disposable load is reduced.

The object of the invention is to make it possible to increase the carrying capacity of a ship of steel concrete or prestressed concrete without excessively increasing its weight, and to achieve an optimum and economical utilization of the material.

This problem is solved according to the invention in this way that the bulkhead partitions are arranged with their base in honeycomb fashion in a hexagonal raster symmetrically to the longitudinal axis of the ship's body in such a way that hexagon sides extend in a right angle to its longitudinal axis and that the bottom of the ship's body, seen in cross section, is recessed in the range of the longitudinal bulkheads formed by the zig-zag arrangement of bulkhead partitions.

The outer walls and the bottom of the ship's body extend preferably in a steady curve.

The deck surface is preferably curved upward — seen in the cross section of the ship's body.

The use of a hexagonal raster for the subdivision of a ship's body is known from British patent 119,189. There individual prefabricated hexagonal cells are connected by belts with the adjoining walls. Here the hexagonal raster is used strictly as a geometric subdivision. A static interaction between the sides of the outer skin the deck and the bulkhead partitions, as in a monolithic ship's body, is not produced.

The invention utilizes the properties of a hexagon that its side length is smaller, with a comparable base, than that of a square or of a rectangle. The span of the individual bulkhead partitions is thus considerably smaller with a hexagonal raster than with a rectangular raster, so that, with the same volume of the cells thus formed, the wall thicknesses can be reduced or with the same thicknesses greater spans can be bridged. In addition if prestress is used, the stressing members only have to extend over the lengths of the hexagon sides, hence they are short and straight, and can be easily anchored and tightened in the intersections from three sides.

The formation of the bulkhead partitions in the form of a hexagonal raster also has advantages regarding the stress on the bottom of the ship's body, because the spans are reduced here relative to a rectangular raster. If a number of hexagonal cells are so arranged according to the invention in the longitudinal axis of the ship's body symmetrically to the latter that hexagon sides extend in a right angle to the longitudinal axis, the bulkhead partitions directed toward the outer walls of the ship's body form a zig-zag row, which means a reduction of the transverse span of the bottom, compared to a straight longitudinal bulkhead.

If, in addition to this design of the bulkhead partitions, the bottom is so designed that it is curved like a dish and recessed in the range of the longitudinal bulkheads extending in zig-zag form, this results in further savings of material, because the bottom acts in transverse direction not on a pure curve, but as a hollow arch. In operation, too, there are advantages because the cargo in the individual cells converges toward the lowest point. When bulk goods are loaded, the advantage is seen in the fact that the hexagon better adapts itself to the normal poured cone than a square or a rectangle, for example.

The invention will be described more fully below on the basis of an embodiment represented in the drawing.

Figure 1:
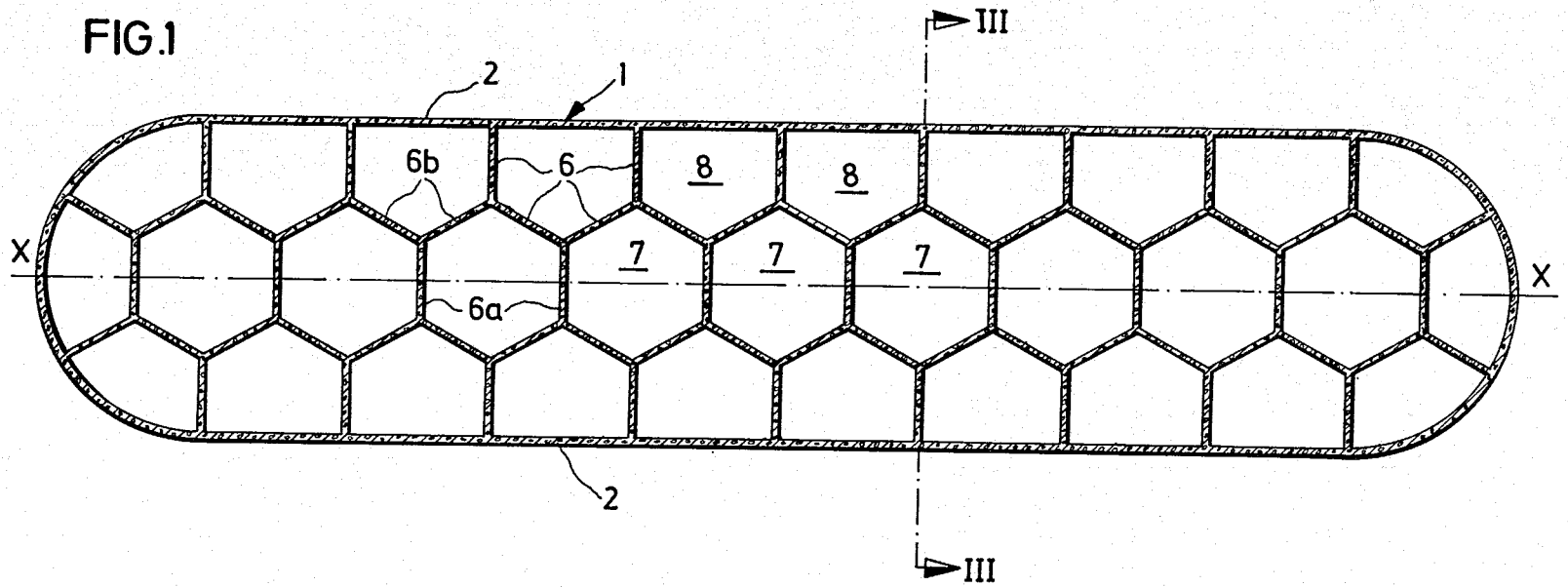
FIG. 1 shows a horizontal section through a ship's body according to the invention.
Figure 2:
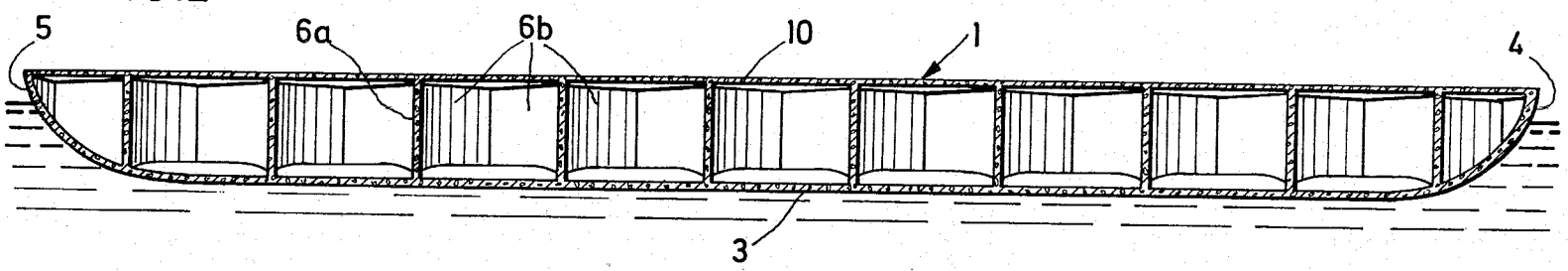
FIG. 2 shows a longitudinal section along the line II—II of FIG. 3.

The drawing shows a so-called lighter, that is, a ship which has no drive of its own. The ship's body 1 consists of a skin of outer walls 2 and bottom 3, which pass over into one another in a constant curve, as shown in a cross section in FIG. 3. The ship's body is equipped with a spoon bow 4 and a spoon stern 5, the stern can also be so designed that tug boats can engage it. The skin consists of prestressed concrete, like the bulkhead partitions 6 provided for the design of cells inside the ship's body and for reinforcement. All parts are joined with each other monolithically.

The bulkhead partitions 6 are arranged in a hexagonal raster symmetrically to the longitudinal axis X—X in such a way that one row of hexagonal walls extends in a right angle to the longitudinal axis X—X. This way a number of cells 7 with a hexagonal base are obtained in the longitudinal axis of the ship's body. The outer walls 2 are joined on each side by a row of cells 8 with a pentagonal base. Depending on the size of the ship's body, five or more rows can be provided instead of the three rows of cells 7 and 8 represented here.

Figure 3:
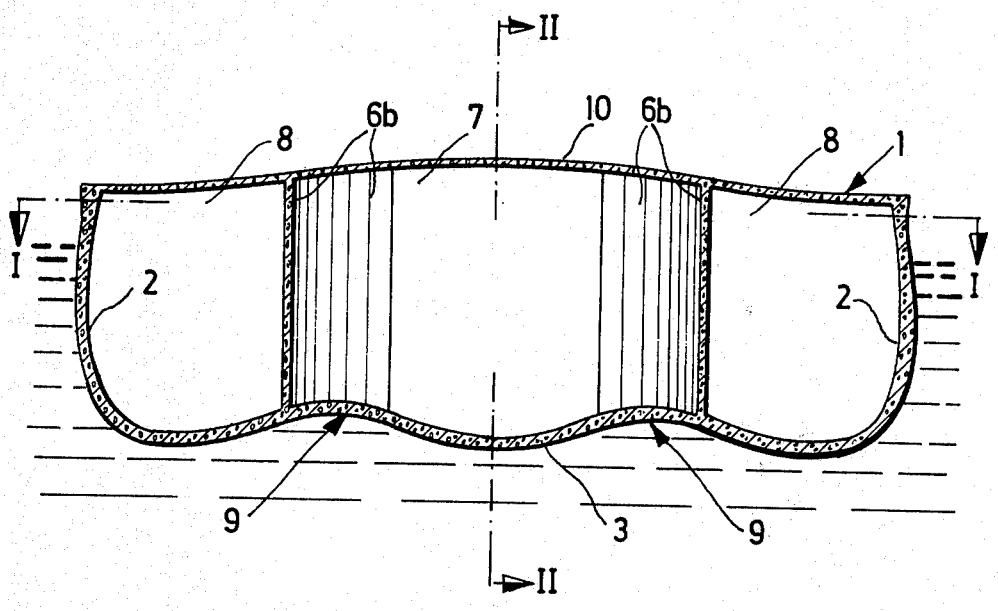
FIG. 3 shows a cross section along the line III—III of FIG. 1.

The bulkhead partitions **6*b* directed toward the outer walls 2 form an angle of 120 deg, with each other and represent a longitudinal bulkhead partition with a zig-zag base, extending substantially parallel to the longitudinal axis X—X. The bottom 3 of the ship's body is recessed in the range of these bulkhead partitions 6*b*, which is indicated in FIG. 3 by reference number 9. The repeatedly changing steady curvature of the outer walls 2 and bottom 3** results in an extremely high arch supporting effect of these parts.

The hold formed by the outer walls 2 and the bulkhead partitions 6 is terminated at the top by a deck surface 10. This deck surface 10 too has preferably upward curvature to achieve an arch supporting effect. In the deck surface 10 can be provided openings, hatches, etc. to make the individual cells 7, 8 accessible.

The ship's body of steel concrete or prestressed concrete designed according to the invention can principally be used for any purpose. In addition to the design as a lighter represented and described here, it is possible to install separate driving units with a suitable design of the bow and stern. The design of the bulkhead partitions and the resulting cell division permit the transportation of any goods, particularly liquid or bulk goods.

I claim:

1. A monolithic ship's body formed of concrete, said body comprising a hull including a bow, a stern, elongated side walls extending between the bow and stern and a bottom interconnecting said bow, stern and side walls, said hull having a longitudinal axis extending from said bow to said stern, a deck spaced above said bottom and interconnecting said bow, stern and side walls, said hull and deck forming an enclosed space, and bulkhead partitions positioned within the enclosed space extending upwardly from said bottom and in combination with said hull dividing the enclosed space into a number of compartments, wherein the improvement comprises that said bulkhead partitions are formed integrally with said hull, said bulkhead partitions are disposed in an hexagonal arrangement forming a grid symmetrically arranged with respect to the longitudinal axis of said hull, said bulkhead partitions comprising first partitions extending perpendicularly to the longitudinal axis of said hull, and second partitions interconnecting said first partitions and extending generally in the direction of the longitudinal axis and disposed at oblique angles to the longitudinal axis, said bottom of said hull in section extending transversely to the longitudinal axis has an undulating curved configuration with the downwardly facing surface thereof having alternating convex and concave portions, said second partitions extending in at least two zig-zag lines between said bow and stern with the downwardly facing surface of said bottom opposite the base of each said zig-zag line at the junction thereof with said bottom having a concave configuration and said first partitions are disposed in at least three laterally spaced apart longitudinally extending rows, each said longitudinally extending row having a centerline disposed in parallel with the longitudinal axis of said hull and the downwardly facing surface of said bottom aligned below each centerline of said longitudinally extending rows having a convex surface.

2. A monolithic ship's body, as set forth in claim 1, wherein the junction of said side walls and bottom has a curved configuration in section extending transversely of the longitudinal axis of said hull.

3. A monolithic ship's body, as set forth in claim 2, wherein the curved configuration at the junction of said side walls and bottom extends from a location on said side walls spaced from said bottom to a location on said bottom spaced from said side walls.

4. A monolithic ship's body, as set forth in claim 1, wherein said deck in section extending transversely of the longitudinal axis of said hull has a curved configuration with the upwardly facing surface of said deck being convexly shaped.

5. A monolithic ship's body, as set forth in claim 4, wherein said deck is formed integrally with said hull and bulkhead partitions.

6. A monolithic ship's body, as set forth in claim 1, wherein said bulkhead partitions and the compartments defined thereby make up the entire enclosed space within said hull and at least some of said first and second partitions form regular hexagonally shaped compartments symmetrically arranged on the longitudinal axis of said hull.

7. A monolithic ship's body, as set forth in claim 1, wherein said body is formed of steel concrete.

8. A monolithic ship's body, as set forth in claim 1, wherein said body is formed of prestressed concrete.

9. A monolithic ship's body, as set forth in claim 1, wherein the downwardly facing surface of said bottom in section extending transversely of the longitudinal axis of said hull and aligned with the longitudinal axis of said hull is convex.

10. A monolithic ship's body, as set forth in claim 1, wherein adjacent said second partitions are angularly spaced apart by 120°.

* * * * *